US006498432B1

(12) United States Patent
Vossen et al.

(10) Patent No.: US 6,498,432 B1
(45) Date of Patent: Dec. 24, 2002

(54) LOW PRESSURE MERCURY-VAPOR DISCHARGE LAMP WITH ELECTRODE SHIELD MOUNTED ON CURRENT SUPPLY CONDUCTORS

(75) Inventors: Engelbertus Cornelius Petrus Vossen, Eindhoven (NL); Peter Arend Seinen, Eindhoven (NL); Jeroen Peter Balm, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 126 days.

(21) Appl. No.: 09/645,017

(22) Filed: Aug. 24, 2000

(30) Foreign Application Priority Data

Aug. 26, 1999 (EP) ..... 99202761

(51) Int. Cl.[7] ..... H01J 17/04; H01J 17/02; H01J 61/02; H01J 61/04

(52) U.S. Cl. ..... 313/613; 313/580

(58) Field of Search ..... 313/580, 613

(56) References Cited

U.S. PATENT DOCUMENTS

| | | | | |
|---|---|---|---|---|
| 3,013,169 A | * | 12/1961 | Gungle et al. | 313/240 |
| 5,612,585 A | * | 3/1997 | Verschueren | 313/25 |
| 5,686,795 A | * | 11/1997 | Sakoske et al. | 313/242 |
| 6,049,164 A | * | 4/2000 | Van Kemenade et al. | 313/483 |
| 6,222,318 B1 | * | 4/2001 | Oomen et al. | 313/243 |
| 6,274,981 B1 | * | 8/2001 | Ronda et al. | 313/492 |

FOREIGN PATENT DOCUMENTS

| | | | |
|---|---|---|---|
| DE | 1060991 | 7/1959 | |
| WO | 0025345 | 5/2000 | H01J/61/04 |

OTHER PUBLICATIONS

Patent Abstract of Japan, vol. 005, No. 074 (E–057), May 16, 1981 (JP 56022040A).

* cited by examiner

*Primary Examiner*—Nimeshkumar D. Patel
*Assistant Examiner*—Matthew P Hodges
(74) *Attorney, Agent, or Firm*—Dicran Halajian

(57) ABSTRACT

A low-pressure mercury-vapor discharge lamp comprises a discharge vessel (10) and a first and a second end portion (12*a*). The discharge vessel (10) encloses a discharge space provided with a filling of mercury and a rare gas in a gastight manner. Each end portion (12*a*) supports an electrode (20*a*) arranged in the discharge space. Current supply conductors (30*a*, 30*a*') extend from the electrodes (20*a*) through the end portions (12*a*) so as to project from the discharge vessel (10). An electrode shield (22*a*) encompasses at least one of the electrodes (20*a*). According to the invention, the electrode shield (22*a*) is mounted on the current supply conductors (30*a*, 30*a*'). Preferably, the electrode shield is clamped to the current supply conductors. The electrode shield is preferably provided with recesses to accommodate the current supply conductors. Preferably, the current supply conductors are flattened at the location where the electrode shield is mounted on the current supply conductors. Preferably, the electrode shield (22*a*) is made from a ceramic material. The lamp according to the invention can be readily manufactured and exhibits a comparatively low mercury consumption.

17 Claims, 3 Drawing Sheets

LOW PRESSURE MERCURY-VAPOR DISCHARGE LAMP WITH ELECTRODE SHIELD MOUNTED ON CURRENT SUPPLY CONDUCTORS

BACKGROUND OF THE INVENTION

The invention relates to a low-pressure mercury-vapor discharge lamp comprising a discharge vessel having a first and a second end portion, wherein the discharge vessel encloses a discharge space containing a filling of mercury and an inert gas in a gastight manner, wherein the end portions each support an electrode arranged in the discharge space which electrode is used to generate and maintain a discharge in the discharge space, wherein current supply conductors of the electrodes extend through the end portions so as to project from the discharge vessel, and wherein an electrode shield at least substantially surrounds at least one of the electrodes.

In mercury-vapor discharge lamps, mercury is the primary component for (efficiently) generating ultraviolet (UV) light. An inner surface of the discharge vessel may be provided with a luminescent layer containing a luminescent material (for example a fluorescent powder) for converting UV to other wavelengths, for example to UV-B and UV-A for tanning purposes (sunbed lamps) or to visible radiation for general lighting purposes. Such discharge lamps are therefore also referred to as fluorescent lamps. The discharge vessel of low-pressure mercury-vapor discharge lamps is generally cylindrical in shape with a circular cross-section and comprises both elongated and compact embodiments. In general, the tubular discharge vessel of so-called compact fluorescent lamps comprises a collection of relatively short, straight parts having a relatively small diameter, which straight parts are interconnected by means of bridge pieces and/or via curved pieces. Compact fluorescent lamps are generally provided with an (integrated) lamp cap.

A low-pressure mercury-vapor discharge lamp of the type mentioned in the opening paragraph is known from DE-A 1 060 991. In said known lamp, the electrode shield surrounding the electrode is made from thin sheet titanium and is supported by a supporting wire which is anchored to the end portion. By using an electrode shield, which is also referred to as anode shield or cathode shield, blackening at an inner surface of the discharge vessel is counteracted. In this respect, titanium serves as the getter for chemically binding oxygen, nitrogen and/or carbon. The supporting wire serves to keep the electrode shield in place.

A drawback resides in that mounting of the electrode shield is fairly complicated.

SUMMARY OF THE INVENTION

It is an object of the invention to provide a low-pressure mercury-vapor discharge lamp of the type mentioned in the opening paragraph, which can be manufactured more readily and more economically. A further object of the invention is to provide a low-pressure mercury-vapor discharge lamp having a relatively low mercury consumption.

To achieve this, the low-pressure mercury-vapor discharge lamp in accordance with the invention is characterized in that the electrode shield is mounted on the current supply conductors.

Since the electrode shield is supported by the current supply conductors, a supporting wire for keeping the electrode shield in place is not necessary. Often, use is not only made of a supporting wire which is anchored to the end portion of the discharge lamp, but also of a support which comprises (a part of) the electrode shield, which support is connected to the supporting wire. The construction in accordance with the invention enables a support and a supporting wire to be omitted, and, during the manufacture of the discharge lamp, it is no longer necessary to provide the supporting wire in the end portion. As a result, the low-pressure mercury-vapor discharge lamp in accordance with the invention can be manufactured more readily and more economically.

A preferred embodiment of the low-pressure mercury-vapor discharge lamp in accordance with the invention is characterized in that the electrode shield is clamped to the current supply conductors. The advantage of this construction resides in that the electrode shield is provided in a predetermined place on the current supply conductors, so that the electrode shield surrounds the electrodes in the desired manner. Clamping the electrode shield to the current supply conductors helps to hold the electrode shield in place during the service life of the discharge lamp, irrespective of the position of said discharge lamp. If the electrode shield is, for example, tubular, it is desirable for the electrode shield to be positioned at least substantially symmetrically with respect to the electrode. During the manufacture of the discharge lamp, the electrode shield is slid over the current supply conductors until it is in a predetermined position.

An alternative embodiment of the low-pressure mercury-vapor discharge lamp in accordance with the invention is characterized in that the current supply conductors are flattened, at the location of the mounted electrode shield, in a plane parallel to the electrodes. By flattening a part of the current supply conductors at the location of the mounted electrode shield, it becomes possible to mount the electrode shield in a predetermined position without exerting a clamping force. Said flat part in the current supply conductors helps to hold the electrode shield in place during the service life of the discharge lamp, irrespective of the position of the discharge lamp.

In a further alternative, favorable embodiment of the low-pressure mercury-vapor discharge lamp in accordance with the invention, the electrode shield is provided with an incision at the location of the current supply conductors. During the manufacture of the discharge lamp, the current supply conductors are bent outwards, for example to provide the electrodes with an electron-emitting substance. Before the current supply conductors are bent back to the desired position, the electrode shield is provided, and the current supply conductors are positioned in the incisions in the electrode shield. The width of the incisions in the electrode shield may be such that the electrode shield is mounted so as to be a press fit on the current supply conductors.

Preferably, the electrode shield is provided with a slit on a side facing the discharge space. A slit in the electrode shield in the direction of the discharge brings about a relatively short discharge path between the electrodes of the low-pressure mercury-vapor discharge lamp. This is favorable for obtaining a high-efficiency lamp. The slit extends preferably in a direction parallel to the axis of symmetry of the electrode shield (so-called lateral slit in the electrode shield). In the known lamp, the opening or slit in the electrode shield faces away from the discharge space.

A preferred embodiment of the low-pressure mercury-vapor discharge lamp in accordance with the invention is characterized in that the electrode shield is made from a ceramic material.

To obtain properly functioning low-pressure mercury-vapor discharge lamps, the electrodes of such discharge lamps comprise an (emitter) material with a low so-called work function (reduction of the work function voltage) to supply electrons to the discharge (cathode function) and receive electrons from the discharge (anode function). Known materials having a low work function are, for example, barium (Ba), strontium (Sr) and calcium (Ca). It has been observed that, during operation of the low-pressure mercury-vapor discharge lamp, material (barium and strontium) evaporates from the electrode(s). In general, the emitter material is deposited on the inner wall of the discharge vessel. It has further been found that the above-mentioned Ba (and Sr), which is deposited elsewhere in the discharge vessel, no longer participates in the light-generation process. The deposited (emitter) material further forms mercury-containing amalgams on the inner wall, causing the quantity of mercury available for the discharge to decrease (gradually), which may adversely affect the service life of the lamp. In order to compensate for such mercury loss during the service life of the lamp, a relatively high quantity of mercury is necessary in the lamp, which is undesirable from the point of view of environmental protection. The provision of an electrode shield, which surrounds the electrode(s) and is made from a ceramic material, reduces the reactivity of materials in the electrode shield relative to the mercury in the discharge vessel, leading to the formation of amalgams (Hg—Ba, Hg—Sr). In addition, the use of an electrically insulating material precludes the development of short circuits of the pole wires of the electrode(s) and/or of a number of windings of the electrode (s). The known lamp has an electrode shield of an electro-conductive material, which, in addition, relatively readily forms an amalgam with mercury. The mercury consumption of the discharge lamp is limited by substantially reducing the degree to which the material of the shield surrounding the electrode(s) reacts with mercury.

The electrode shield itself should not appreciably absorb mercury. To achieve this, the material of the electrode shield includes at least an oxide of at least one element of the series formed by magnesium, aluminium, titanium, zirconium, yttrium and the rare earths. Preferably, the electrode shield is made from a ceramic material which comprises aluminium oxide. Particularly suitable electrode shields are manufactured from so-called densely sintered $Al_2O_3$, also referred to as DGA. An additional advantage of the use of aluminium oxide is that an electrode shield made of such a material is resistant to relatively high temperatures. At such relatively high temperatures, there is an increased risk that the (mechanical) strength of the electrode shield decreases, thus adversely affecting the shape of the electrode shield. If a metal or a metal alloy is used as the electrode shield, as is the case in the known discharge lamp, the temperature of the electrode shield must not be too high to prevent that the metal or one of the metals of the metal alloy begins to deform or evaporate, thereby giving rise to undesirable blackening of the inner surface of the discharge vessel. (Emitter) material originating from the electrode(s) and deposited on an electrode shield of aluminium oxide which is at a much higher temperature, cannot, or hardly, react with the mercury present in the discharge, as a result of said high temperature, so that the formation of mercury-containing amalgams is at least substantially precluded. In this manner, the use of an electrode shield in accordance with the invention serves a dual purpose. On the one hand, it is effectively precluded that material originating from the electrode(s) is deposited on the inner surface of the discharge lamp, and, on the other hand, it is precluded that (emitter) material deposited on the electrode shield forms amalgams with the mercury present in the discharge lamp. In addition, Ba, Sr and Ca may react with $Al_2O_3$ forming the corresponding aluminates which no longer bind Hg. Preferably, in operation, the temperature of the electrode shield exceeds 250° C. An advantage of such a relatively high temperature is that, in particular, in the initial stage, the electrode shield becomes hotter than in the known lamp, as a result of which any mercury bound to the electrode shield is released more rapidly and more readily.

These and other aspects of the invention will be apparent from and elucidated with reference to the embodiments described hereinafter.

BRIEF DESCRIPTION OF THE DRAWINGS

The Figures are purely schematic and not drawn to scale. Particularly for clarity, some dimensions are exaggerated strongly. In the Figures, like reference numerals refer to like parts whenever possible.

DETAILED DESCRIPTION OF THE EMBODIMENTS

Figure 1:
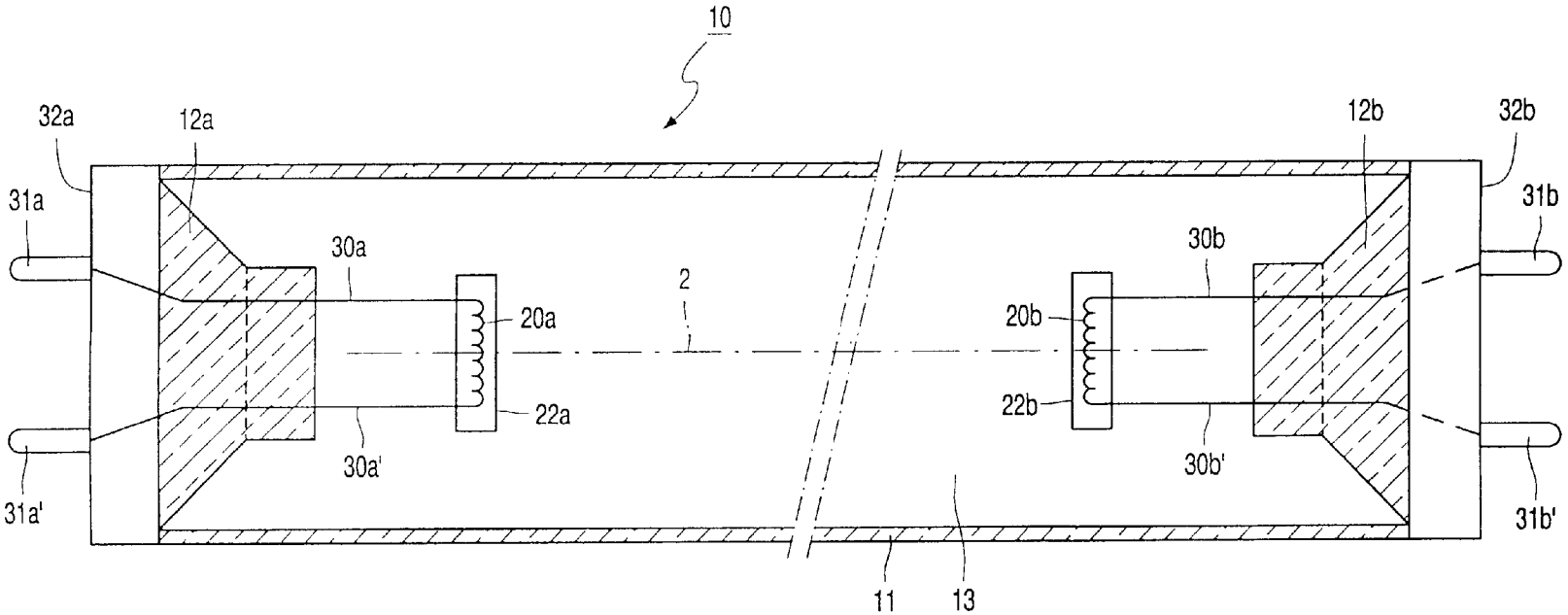
FIG. 1 is a longitudinal sectional view of an embodiment of the low-pressure mercury-vapor discharge lamp in accordance with the invention.

FIG. 1 shows a low-pressure mercury-vapor discharge lamp comprising a glass discharge vessel 10 having a tubular portion 11 about a longitudinal axis 2, which discharge vessel transmits radiation generated in the discharge vessel 10 and is provided with a first and a second end portion 12*a*; 12*b*, respectively. In this example, the tubular part 11 has a length of 115 cm and an outside diameter of 16 mm. The discharge vessel 10 encloses, in a gastight manner, a discharge space 13 containing a filling of less than 3 mg mercury and an inert gas, for example argon. The wall of the tubular part is generally coated with a luminescent layer (not shown in FIG. 1) which includes a luminescent material (for example a fluorescent powder) which converts the ultraviolet (UV) light generated by fallback of the excited mercury into (generally) visible light. The end portions 12*a*; 12*b* each support an electrode 20*a*; 20*b* arranged in the dis current-supply conductors 30*a*, 30*a*'; 30*b*, 30' of the electrodes 20*a*; 20*b*, respectively, pass through the end portions 12*a*; 12*b* and project from the discharge vessel 10. The current supply conductors 30*a*, 30*a*'; 30*b*, 30*b*' are connected to contact pins 31*a*, 31*a*'; 31*b*, 31*b*' which are secured to a lamp cap 32*a*, 32*b*. In general, around each electrode 20*a*; 20*b*, an electrode ring is arranged (not shown in FIG. 1) to which a glass capsule for proportioning mercury is clamped. In an alternative embodiment, an amalgam comprising mercury and an alloy of PbBiSn is provided in an exhaust tube (not shown in FIG. 2) which is in communication with the discharge vessel.

Figure 2:
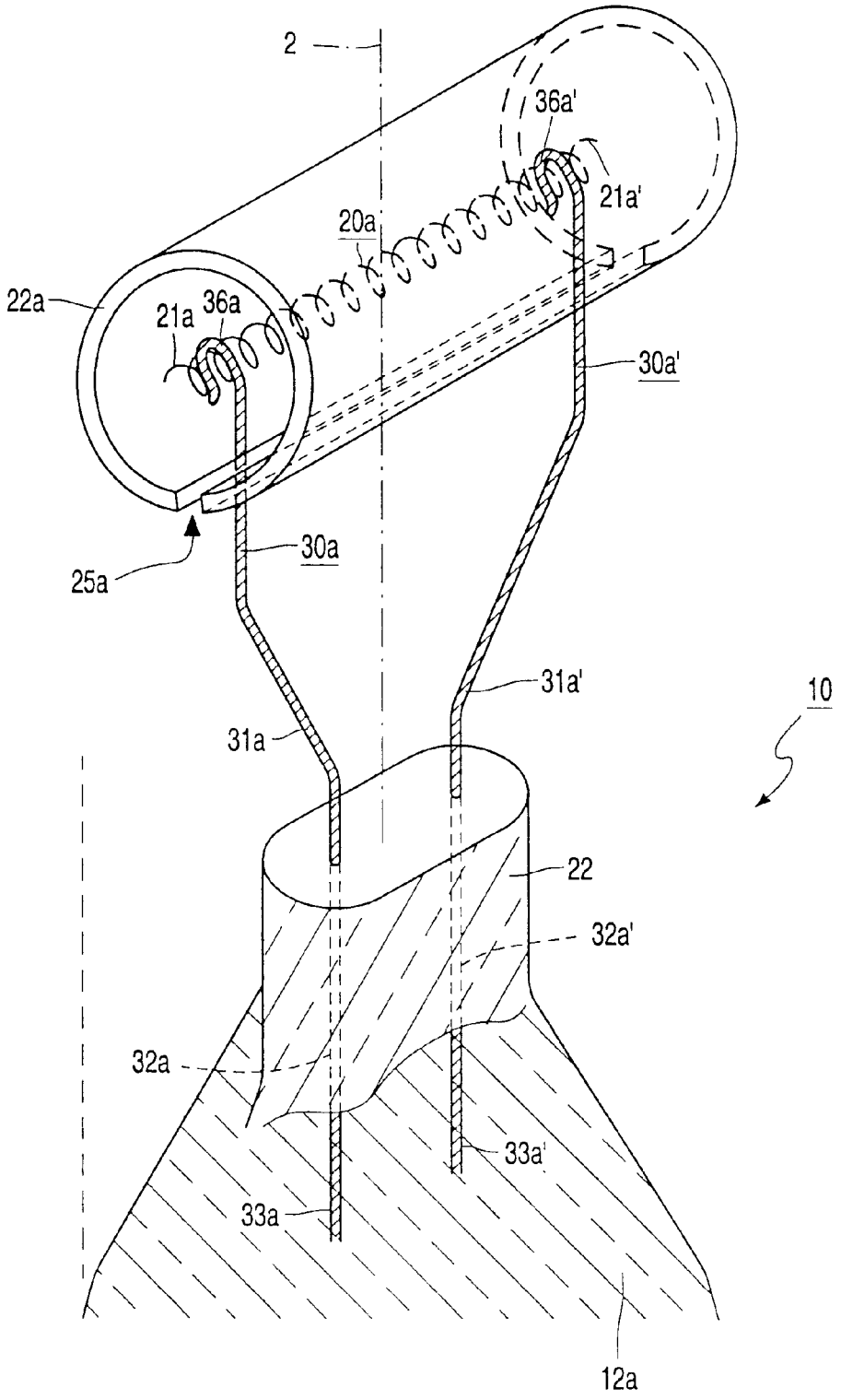
FIG. 2 is a perspective view of a detail of the discharge lamp shown in FIG. 1.

In the example shown in FIG. 1, the electrode 20*a*; 20*b* is surrounded by electrode shield 22*a*; 22*b* which, in accordance with the invention, is supported by the current supply conductors 30*a*, 30*a*'; 30*b*, 30*b*'. FIG. 2 shows a detail, partly in perspective, of FIG. 1, wherein a tubular electrode shield 22*a* is provided with a slit 25*a*. This slit 25*a* is situated on the side of the electrode shield 22*a* facing away from the discharge space 13. In order to keep the electrode shield 22*a* in place during its service life, it is press fitted onto the current supply conductors 30*a*, 30*a*'.

In FIG. 2, the current supply conductors 30*a*, 30*a*' are provided, at the first end portion 12*a*, with a first segment 31*a*, 31*a* of iron wire with a thickness of 0.6 mm, a second segment 32*a*, 32*a*' of NiFeCuMn wire with a thickness of 0.35 mm and a third segment 33*a*, 33*a*' of CuSn wire with a thickness of 0.35 mm, which segments extend predominantly in, respectively, the discharge vessel 10, a wall 22, and outside the discharge vessel 10 (see FIG. 2, wherein the second segments 32*a*, 32*a*' are represented by means of broken lines). The lamp is correspondingly constructed at the end portion 12*b* (not shown in FIG. 2).

The electrode 20*a*; 20*b* is a winding of tungsten which is covered with an electron-emitting substance, in this case a mixture of barium oxide, calcium oxide and strontium oxide. The electrode 20*a*; 20*b* comprises a winding which is clamped, on either end 21*a*, 21*b*, in a curve 36*a*, 36*b* of a respective current supply conductor 30*a*, 30*b*.

In the manufacture of the discharge lamp shown in FIG. 2, first an electrode 20*a*; 20*b* is mounted on the current supply conductors 30*a*, 30*a*'; 30*b*, 30*b*'. The tubular electrode shield 22*a*; 22*a*' is subsequently slid over the current supply conductors 30*a*, 30*a*'; 30*b*, 30*b*', so that the slit 25*a* preferably tightly grips the current supply conductors 30*a*, 30*a*'; 30*b*, 30*b*'. It is alternatively possible to heat the electrode shield 22*a*; 22*a*' prior to mounting, thereby causing the size of the slit 25 to be slightly increased, enabling the electrode shield 22*a*; 22*a*' to be readily mounted. After cooling, the edges of the slit slightly press on the current supply conductors 30*a*, 30*a*'; 30*b*, 30*b*', so that the electrode shield 22*a*; 22*a*' and the current supply conductors 30*a*, 30*a*'; 30*b*, 30*b*' are interconnected through a clamp connection.

Figure 3:
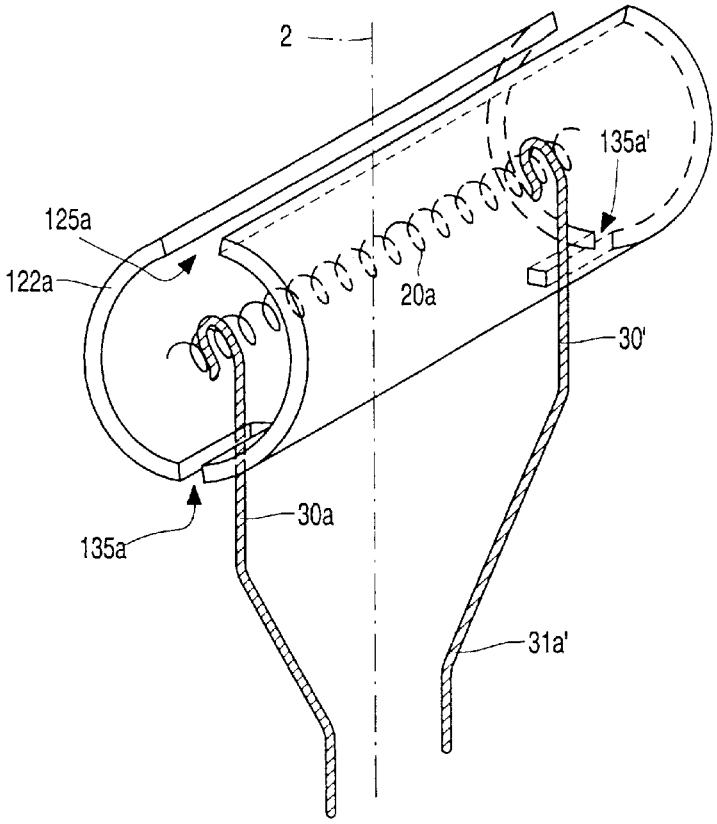
FIG. 3 shows an alternative embodiment of a low-pressure mercury-vapor discharge lamp comprising an electrode shield in accordance with the invention.

FIG. 3 shows an alternative embodiment of a low-pressure mercury-vapor discharge lamp comprising an electrode shield in accordance with the invention, the (tubular) electrode shield 122*a* being provided with an incision 135*a*; 135*a*' at the location of the current supply conductors 30*a*, 30*a*'. In the example shown in FIG. 3, the electrode shield 122*a* is provided, on a side facing the discharge space 13, with a slit 125*a*.

In the manufacture of the discharge lamp, as shown in FIG. 3, first an electrode 20*a* is mounted on the current supply conductors 30*a*, 30*a*'. Subsequently, the current supply conductors 30*a*, 30*a*' are bent outwards, causing the electrode 20*a* to become longer. Subsequently, the electrode 20*a* is customarily provided with a layer of emitter material by immersing it in a suitable bath. Next, the electrode shield 122*a* is provided by sliding the slit 125*a* over the current supply conductors 30*a*, 30*a*'. Subsequently, the electrode shield 122*a* is rotated 180° about the electrode 20*a*, causing the slit 122*a* to be positioned towards the side facing the discharge space 13. In the final step, the current supply conductors 30*a*, 30*a*' are bent towards each other again, thereby guiding the current supply conductors 30*a*, 30*a*' into the incisions 135*a*; 135*a*'. To attain a satisfactory assembly, the current conductors 30*a*, 30*a*'; 30*b*, 30*b*' are preferably tightly fit in the incisions 135*a*; 135*a*', respectively. The size of the slit 125*a* in the electrode shield 122*a* need not exceed the thickness of the current supply conductors 30*a*, 30*a*' and hence can be much smaller, in general, than the external diameter of the electrode 20*a*.

Figure 4:
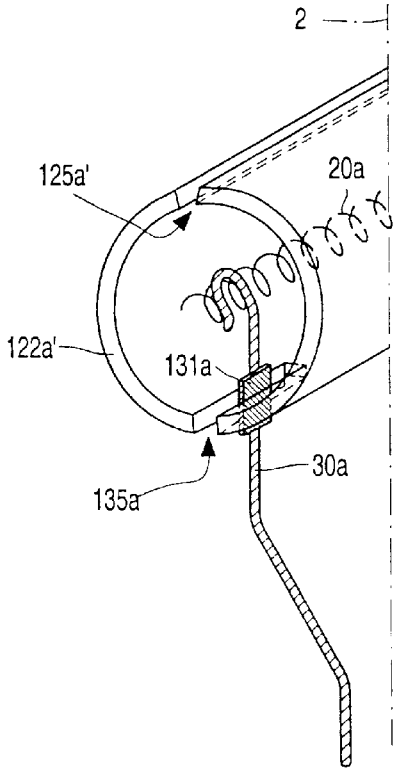
FIG. 4 shows a further alternative embodiment of a low-pressure mercury-vapor discharge lamp comprising an electrode shield in accordance with the invention.

FIG. 4 shows a further alternative embodiment of a low-pressure mercury-vapor discharge lamp comprising an electrode shield 122*a*' in accordance with the invention. In the example shown in FIG. 4, only a part of the corresponding electrode shield 122*a* of FIG. 3 is shown. In FIG. 4, as in the example shown in FIG. 3, the (tubular) electrode shield 122*a*' is provided, on a side facing the discharge space 13, with a slit 125*a*'. In order to simplify the mounting of the electrode shield 122*a*', the current supply conductor 30*a* is provided with a flattened part 131*a* at the location of the mounted electrode shield 122*a*'. To this end, the current supply conductor 30*a* is flattened in a plane extending parallel to the electrode 20*a*. Corresponding flattened parts are provided in the other current supply conductors 30*a*'; 30*b*, 30*b*' (not shown). The flattened part 131*a* may be provided in the current supply conductor 30*a*, for example, by means of mechanical deformation. This mechanical deformation may have been performed such that the surface of the flattened part 131*a* is provided with a structure increasing the mechanical roughness of the flattened part 131*a*, for example by providing a pattern of saw teeth. These measures enable a low-pressure mercury-vapor discharge lamp to be obtained which can be readily and economically manufactured.

It will be clear that the size of the slit 125*a*' in the electrode shield 122*a* need not be larger than the thickness of the flattened part 131*a* in the current supply conductors 30*a*, 30*a*' and hence can be much smaller, in general, than the external diameter of the electrode 20*a*. Since the slit 125*a*' in the electrode shield 122*a*' is very narrow, the mercury consumption of the low-pressure mercury-vapor discharge lamp is limited considerably.

In general, the slit in the electrode shield does not have to be larger than the minimum slit width necessary for the discharge in the discharge space to reach the spiral-shaped electrode.

The tubular electrode shield with the relatively very narrow slit reduces the risk that (emitter) material originating from the electrode is deposited on the inner wall of the discharge vessel, causing undesirable blackening. If such an electrode shield is made from a ceramic material, for example densely sintered aluminium oxide (DGA), it is also achieved that (emitter) material deposited on the ceramic electrode shield has such a high temperature during operation of the low-pressure mercury-vapor discharge lamp that the material cannot form mercury-containing amalgams, so that a substantial further reduction in mercury consumption by the lamp is achieved.

The electrode shield is preferably made of a ceramic material which, in operation, has a temperature above 250° C., preferably above 300° C. At such high temperatures there are hardly any stable mercury compounds. Preferably, the electrode shield is made from a material which is not electrically conducting or at least very poorly electrically conducting, in order to preclude a short circuit between the current supply conductors.

In experiments, TLD/82/36W and F32/T8/83-type low-pressure mercury-vapor discharge lamps provided with an electrode shield in accordance with the invention are operated on a so-called high-frequency regulating dimming ballast, and the mercury consumption in the region of the electrode is measured and compared to that of a reference lamp provided with the known electrode shield. The discharge lamps are operated on a dimming ballast with a so-called long switching cycle in which the lamp, alternately, bums for 165 minutes and is switched off for 15 minutes. After 13,500 burning hours, low-pressure mercury-vapor discharge lamps comprising an electrode provided with a tubular electrode shield manufactured from DGA exhibited a relatively narrow slit facing the discharge space (slit width below 1 mm), a mercury consumption in the region of the electrode (measured for each electrode) below 100 $\mu$g, while the known lamp exhibits a mercury consumption in the region of the electrode of 200–300 pg. The temperature of the electrode shield in accordance with the invention was, in operation, in the range between 350 and 450° C., while the temperature of the known electrode shield was in the range between 200 and 300° C. This comparison shows that the known discharge lamps have a much higher mercury consumption during their service life than the discharge lamps provided with an electrode shield in accordance with the invention.

It will be obvious that, within the scope of the invention, many variations are possible to those skilled in the art. For example, the electrode shield does not necessarily have to be tubular; it may alternatively take different shapes, such as a volute-shaped electrode shield. The electrode shield may also be manufactured from a combination of glass and a metal, for example a glass ring-shaped body provided with a $Fe_2O_3$ film.

The scope of protection of the invention is not limited to the above-described examples. The invention is embodied in each novel characteristic and each combination of characteristics. Reference numerals in the claims do not limit the scope of protection thereof. The use of the term "comprising" does not exclude the presence of elements other than those mentioned in the claims. The use of the word "a" or "an" before an element does not exclude the presence of a plurality of such elements.

What is claimed is:

1. A low-pressure mercury-vapor discharge lamp comprising a discharge vessel having a first and a second end portion, wherein the discharge vessel encloses a discharge space containing a filling of mercury and an inert gas in a gastight manner, wherein the end portions each support an electrode arranged in the discharge space which electrode is used to generate and maintain a discharge in the discharge space, wherein current supply conductors of the electrodes extend through the end portions so as to project from the discharge vessel, wherein an electrode shield at least substantially surrounds at least one of the electrodes, wherein the electrode shield is mounted on the current supply conductors, and wherein the current supply conductors are flattened, at the location of the mounted electrode shield, in a plane parallel to the electrodes.

2. A low-pressure mercury-vapor discharge lamp comprising a discharge vessel having a first and a second end portion, wherein the discharge vessel encloses a discharge space containing a filling of mercury and an inert gas in a gastight manner, wherein the end portions each support an electrode arranged in the discharge space which electrode is used to generate and maintain a discharge in the discharge space, wherein current supply conductors of the electrodes extend through the end portions so as to project from the discharge vessel, wherein an electrode shield at least substantially surrounds at least one of the electrodes, wherein the electrode shield is mounted on the current supply conductors, and wherein the electrode shield is provided with an incision at the location of the current supply conductors.

3. A low-pressure mercury-vapor discharge lamp as claimed in claim 2, wherein the electrode shield is clamped to the current supply conductors.

4. A low-pressure mercury-vapor discharge lamp as claimed in claim 2 wherein the electrode shield is provided with a slit on a side facing away from the discharge space.

5. A low-pressure mercury-vapor discharge lamp as claimed in claimed 2, wherein the electrode shield is provided with a slit on a side facing the discharge space.

6. A low-pressure mercury-vapor discharge lamp as claimed in claim 2, wherein the electrode shield is tubular in shape.

7. A low-pressure mercury-vapor discharge lamp as claimed in claim 2, wherein the electrode shield is made from a ceramic material.

8. A low-pressure mercury-vapor discharge lamp as claimed in claim 7, wherein the ceramic material comprises aluminum oxide.

9. A low-pressure mercury-vapor discharge lamp as claimed in claim 7, wherein, in operation, a temperature of the electrode shield exceeds 250° C.

10. A low-pressure mercury-vapor discharge lamp comprising a discharge vessel, the discharge vessel enclosing in a gastight manner a discharge space containing a filling of mercury and an inert gas, an electrode arranged in the discharge space, at least two current supply conductors of the electrode extending from the discharge vessel, an electrode shield at least substantially surrounding the electrode, at least one of the at least two current supply conductors having a flattened portion in a plane parallel to a length of the electrode, the electrode shield being provided with an incision at the location of the flattened portion, the electrode shield being fixed on said one of the at least two current supply conductors, at the incision and flattened portion.

11. A low-pressure mercury-vapor discharge lamp as claimed in claim 10, wherein the electrode shield is clamped to the current supply conductors.

12. A low-pressure mercury-vapor discharge lamp as claimed in claim 10, wherein the electrode shield is provided with a slit on a side facing away from the discharge space.

13. A low-pressure mercury-vapor discharge lamp as claimed in claim 10, wherein the electrode shield is tubular in shape.

14. A low-pressure mercury-vapor discharge lamp as claimed in claim 10, wherein the electrode shield is made from a ceramic material.

15. A low-pressure mercury-vapor discharge lamp as claimed in claim 10, wherein, in operation, a temperature of the electrode-shield exceeds 250° C.

16. A low-pressure mercury-vapor discharge lamp as claimed in claim 10, wherein the electrode shield is provided with a slit on a side facing the discharge space.

17. A low-pressure mercury-vapor discharge lamp as claimed in claim 10, wherein the width of the incision in the electrode shield is set for a press fit of the electrode shield on said one of the at least two current supply conductors.

* * * * *